US005310352A

United States Patent [19]

Mroczkowski et al.

[11] Patent Number: 5,310,352

[45] Date of Patent: May 10, 1994

[54] SUBSTRATE INTERFACING ELECTRICAL CONNECTOR SYSTEM

[75] Inventors: Robert S. Mroczkowski, Lititz; Richard E. Rothenberger, Harrisburg, both of Pa.

[73] Assignee: The Whitaker Corporation, Wilmington, Del.

[21] Appl. No.: 996,750

[22] Filed: Dec. 24, 1992

[51] Int. Cl.[5] ..... H01R 13/62; H01R 23/72

[52] U.S. Cl. ..... 439/76; 439/289; 439/372; 439/374; 439/378; 439/468

[58] Field of Search ..... 439/67, 76, 77, 493, 439/372, 329, 66, 374, 378, 289, 473, 468

[56] References Cited

U.S. PATENT DOCUMENTS

| | | | |
|---|---|---|---|
| 3,629,787 | 12/1971 | Wilson | 439/493 |
| 3,648,002 | 3/1972 | DuRocher | 439/372 |
| 4,329,005 | 5/1982 | Braginetz et al. | 439/51 |
| 4,361,634 | 11/1982 | Miller | 430/5 |
| 4,406,062 | 9/1983 | Navarro | 439/77 |
| 4,453,795 | 6/1984 | Moulin | 439/361 |
| 4,542,951 | 9/1985 | Mummey et al. | 339/75 M |
| 4,699,593 | 10/1987 | Grabbe et al. | 439/71 |
| 4,869,680 | 9/1989 | Yamamoto et al. | 439/372 |
| 4,900,258 | 2/1990 | Hnatuck et al. | 439/63 |
| 4,927,369 | 5/1990 | Grabbe et al. | 439/66 |
| 5,049,090 | 9/1991 | Johnson | 439/329 |
| 5,073,127 | 12/1991 | Daly et al. | 439/473 |
| 5,105,095 | 4/1992 | Rudy, Jr. et al. | 307/17 |
| 5,190,473 | 3/1993 | Mroczkowski et al. | 439/580 |

OTHER PUBLICATIONS

AMP Technical Paper P261-82, "Design Considerations for High Pin Count Cammed Rectangular Zero Insertion Force Connectors", Smith; Nov. 1982; seven pages; AMP Incorporated, Harrisburg, Pa.

AMP Catalog 85-766, "CR Connector Systems Zero Insertion Force", pp. 1-7; 18-22; Feb. 1990; AMP Incorporated, Harrisburg, Pa.

AMP Instruction Sheet IS 6687, "AMP Cammed Rectangular (CR) 520 and 1040 Zero-Entry-Force Connectors", four pages, Jul. 1987; AMP Incorporated, Harrisburg, Pa.

Rothenberger et al., High-Density Zero Insertion Force Microcoaxial Cable Interconnection Technology, pp. 1-5.

*Primary Examiner*—Neil Abrams

*Attorney, Agent, or Firm*—Anton P. Ness

[57] ABSTRACT

Connectors systems for electrically interfacing contacts to surfaces. The connectors (10) comprise a printed wiring board (30) adapted to receive a connector element (80) which communicates data from an outside source to a device (140) , a housing (20) for mounting the printed wiring board (30), and a securing barrel (120) interfaceable through the printed wiring board and further matable to a mating surface (240) in the device (140) for securing the printed wiring board (30) to a substrate (150) such that the printed wiring board makes effective electrical contact with the substrate (150). Connector systems described and claimed herein are matable and unmatable to an electronic, diagnostic, or other analytical device which utilizes data bussed through the device through the connector. Thus, these connectors (10) are versatile and highly reliable for achieving high integrity electrical interface in the device (140) utilizing the data signals.

The connector system is adapted to be mated with zero insertion force required during initial placement and engagement at the contact interface, after which a rugged manually activated camming system provides substantial mechanical advantages to establish assured contact normal force in a high density mating contact array, and which is easily unmated.

30 Claims, 10 Drawing Sheets

SUBSTRATE INTERFACING ELECTRICAL CONNECTOR SYSTEM

FIELD OF THE INVENTION

This invention relates generally to electrical connectors, and more specifically, to connectors which are adapted to securely interface current-containing substrates for effective electrical contact.

BACKGROUND OF THE INVENTION

Connector systems for interfacing diagnostic or analytical devices with an outside source of data are known. Generally, a connector system comprises at least two electrical interfaces, one on each of two sides of a connector module. On the first side of the connector module, the connector is interfaced with an outside source which generates a signal that is indicative of the state of a system under observation or otherwise activated. On the second side of the connector module, a second interface is provided to bus the signals from the outside source to an analytical or diagnostic device for analysis and data processing at an input/output port. Examples of such devices are ultrasound equipment, radar equipment, computer equipment, and other electronic devices which have an input interface. Connectors have been designed for use with all such devices and others.

In more sophisticated systems which implement high speed data links from the outside source to the device, the connector interfaces can become very complex. To achieve high integrity data communications between the outside source of data and the device, prior connectors have been designed to accommodate high density contacts so that increased data flow through the connector at high frequencies and at high speeds can be achieved. Examples of such connectors and connector systems are found in U.S. Pat. No. 4,699,593, Grabbe et al., and U.S. Pat. No. 4,927,369, Grabbe et al., the teachings of both being specifically incorporated herein by reference.

In the connectors such as those disclosed in the Grabbe et al. patents, the individual electrical interface contact members in the connector modules are usually on 100 mil centerlines which causes the size of the connector modules to increase dramatically as the contact count increases. Furthermore, the actuation forces necessary to achieve the interface between the second side of the connector and the device are greatly increased as the number of pins increases, thereby increasing the possibilities of misalignment of the connector and failure of the data interface. Additionally, many of these prior connectors are utilized in a manner requiring only a relatively small number of mating/unmating cycles.

Connectors to accommodate high contact densities for use in high speed data devices may comprise a plurality of modular connectors with electrical interface contacts as described above and a printed wiring board to which the modular connectors are plugged. The printed wiring boards contain a plurality of circuits that are adapted to communicate the data from the outside source to the device which processes the data. The contact surfaces or pads on the printed wiring boards are typically interfaced with a substrate in the device which is further adapted to receive the communicated data from the outside source. This substrate may be yet another printed wiring board, printed circuit board, or other electrical receiving device which can interface with the contact pads on the printed wiring board in the connector.

When high density contacts are required, an interposer is also oftentimes provided to establish a connection medium between the printed wiring board in the connector and the substrate An "interposer" is typically a land grid array which effectuates and/or facilitates contact between the printed wiring board and the substrate in the device. Such interposers are especially useful when the closely spaced contact surfaces on the connector modules prevent a direct interface from the electrical interface contacts in the connector modules on printed wiring board to the device. The interposer thus provides a separate set of contact elements which must be firmly secured against both the printed wiring board in the connector and a printed wiring board in the device.

It has been found that interfacing the contact pads of a printed wiring board in a connector to another substrate to achieve sufficient electrical contact requires sufficient force to hold the contact pads firmly against the substrate during operation of the device. Typically, the printed wiring boards have merely been screwed or otherwise mated in connectors and brought into contact with the interposer or other substrate which is permanently mated to the device. Through the pressure applied during mating of the printed wiring board to the substrate, the contact pad is pressed to the substrate. However, applicants have recognized that this is frequently an unsatisfactory method of ensuring adequate electrical contact.

Accordingly, applicants have come to appreciate that it would be desirable to provide a connector or connector system having a printed wiring board with the ability to firmly mate the printed wiring board thereof to a-substrate in a device so that data can be bussed to the device through the connector with high reliability. Furthermore, it would be desirable to provide a connector which is both matable and dematable so that the connector can be used with various devices and/or frequently reused with the same device. Such a connector would be both versatile and rugged. Additionally, sufficient means should be provided to the connector to ensure adequate electrical contact of a printed wiring board therein to the device.

SUMMARY OF THE INVENTION

The foregoing problems are solved and objects achieved by connectors for electrically interfacing contacts to a device containing a substrate and a cooperating surface provided in accordance with the present invention. In preferred embodiments, the connectors comprise a printed wiring board adapted to receive a connector element for communicating data from an outside source, housing means for mounting the printed wiring board, and securing means interfaceable through the printed wiring board and further matable to the cooperating surface in the device for securing the printed wiring board to the substrate such that the printed wiring board makes effective electrical contact with the substrate.

Methods provided in accordance with the present invention also solve the aforementioned needs. In further preferred embodiments, methods of connecting a printed wiring board to a device which utilizes signals bussed thereto through the printed wiring board from an outside source are provided. Such devices include ultrasound equipment, radar equipment, computer equipment and so forth. The methods preferably comprise the steps of interfacing a printed wiring board to a contact surface in the device, inserting an interlocking key element through a hole in the printed wiring board and onto a complimentary key channel in the device, and cinching the interlocking key element to the reciprocating key channel so that the printed wiring board is securely pressed against the contact surface in the device.

The connectors described and claimed herein provide efficient and economical means for securing connector systems to devices and for providing adequate electrical contact between an outside source and the device. Thus, connectors in accordance with the present invention ensure that high speed data communication links are maintained at all times that the connectors are interfaced to devices which will utilize the data. Furthermore, the connectors and methods provided in accordance with the present invention ensure that an adequate amount of force is applied to secure printed wiring boards in the connectors to substrates in the devices so that electrical contact between the printed wiring boards and the devices is maintained. Additionally, the present connectors and methods provide for such assured electrical connections in a high density arrangement with the connectors being mated at zero insertion force, after which actuation of the securing means generates the substantial amount of force to assure surface-to-surface contact between the high density contact arrays on the connector and the substrate within the device.

In a preferred aspect of the connectors, economical and efficient electrical contact is achieved since the connector is matable and unmatable to the device and is therefore versatile for use in many different devices. Such results have not heretofore been achieved in the art. These and other advantages of the present invention will be readily understood by those with skill in the art by reading the following Detailed Description in which an embodiment of the invention is described by way of reference to the accompanying drawings.

DETAILED DESCRIPTION OF PREFERRED EMBODIMENTS

Figure 1:
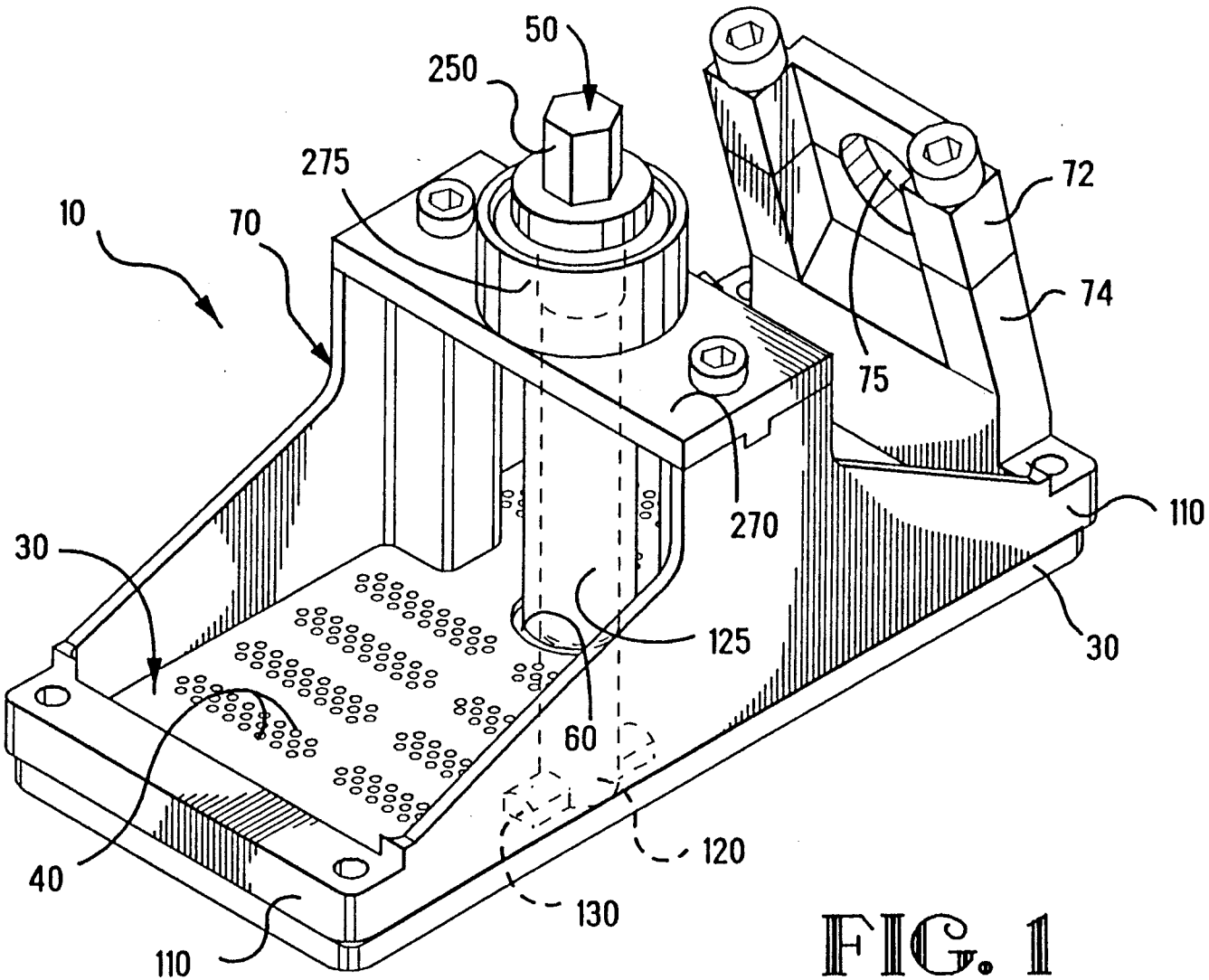
FIG. 1 is an isometric view of framework of a cable side connector in accordance with the present invention having a printed wiring board mounted therein.

Referring now to the drawings wherein like reference numerals refer to like elements, FIG. 1 shows a framework or support structure 70 of a cable side connector in accordance with the present invention shown generally at 10 that is preferably adapted to electrically interface conductors of a cable to circuits of a substrate forming part of a device side connector matable with cable side connector 10. As used herein, the term "substrate" means an electrical component secured to a device which is adapted to receive electrical signals and can include a circuit board or a nest assembly such as an interposer. In a preferred embodiment, cable side connector 10 comprises dielectric housing means 20 encasing support structure, best shown in FIG. 2, and includes a printed wiring board shown generally at 30 which is adapted to receive connector elements such as the modular connectors 80 described above that will communicate data from an Outside source to the connector 10, with the modular connectors 80 terminated to conductors of cables 230 extending through cable exit 75.

Also as used herein, the term "printed wiring board" (PWB) means an electrical component that is adapted to bus data signals from an outside source to a device. Thus, the PWB 30 could be a printed circuit board (PCB) or any other electrical component which busses electrical signals from one location to another. For ease and convenience throughout, the reference to element 30 will be to a PWB.

Figure 3:
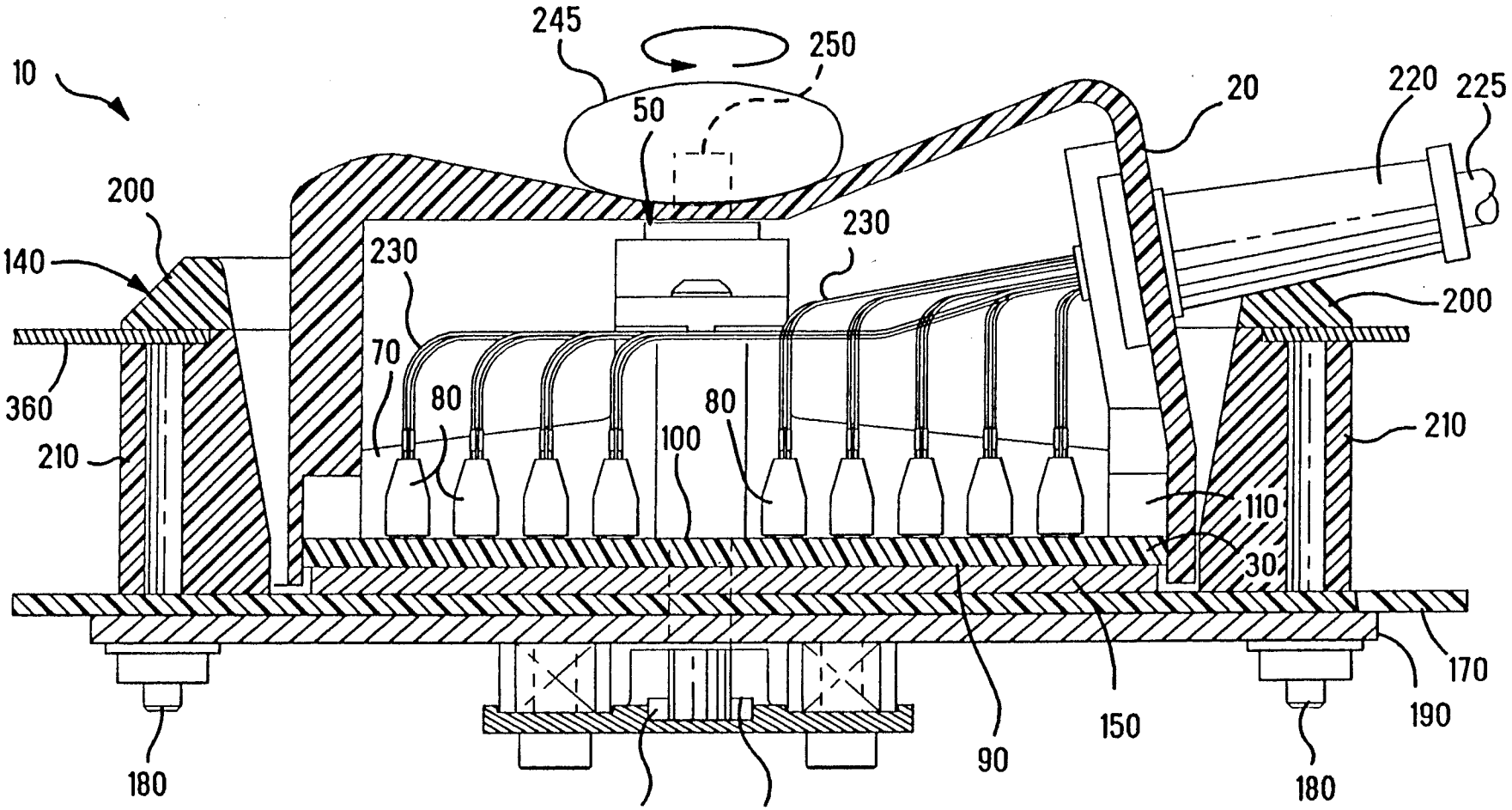
FIG. 3 is also a cross-sectional view of the connector of FIG. 2 which is further interfaced with an interposer and a second printed wiring board that are both mounted to a device at an input/output port which will utilize data bussed through the connector.

PWB 30 is shown to comprise a plurality of plated-through-holes 40 which mate with sections of contact members of the connector elements and then interface the data signals which are bussed through the connector elements and through the device side connector into the device which will utilize the data. In a further preferred embodiment, actuating means 50 is provided to the connector 10 and is interfaceable through the PWB 30, preferably through an opening such as is shown generally at 60 and is utilized to secure cable side connector 10 to the device side connector (FIG. 3). Opening 60 preferably lies substantially in the center of the PWB 30. The actuating means 50 when manually activated is cooperable with a corresponding element in the device to press the PWB 30 against a substrate in the device side connector such that the array of contacts of PWB 30 makes effective electrical contact with the corresponding array of contacts of the substrate.

Connector 10 is shown to be both matable to and unmatable from the substrate in the device. This feature allows connector 10 to be removed from the device at the demand of the operator of the device so that yet other connectors can be mated thereto. Although it is contemplated that the present connectors will be adaptable for use with a wide variety of devices, the device which utilizes connector 10 would for example comprise an analytical or diagnostic-type medical device such as ultrasound equipment, X-ray equipment, or other medical equipment which processes digital data signals from an outside source to perform the diagnostic function. The outside source could be, for example, an ultrasound sensor, or any other type of electrical component which transduces physical parameters to electrical signals which can then be processed by a computer or microprocessor contained in the device. The device is then able to yield useful information concerning the particular parameter under test. However, it will be recognized by those with skill in the art that any device which is adapted to process data will find connectors provided in accordance with the present invention useful.

Figure 2:
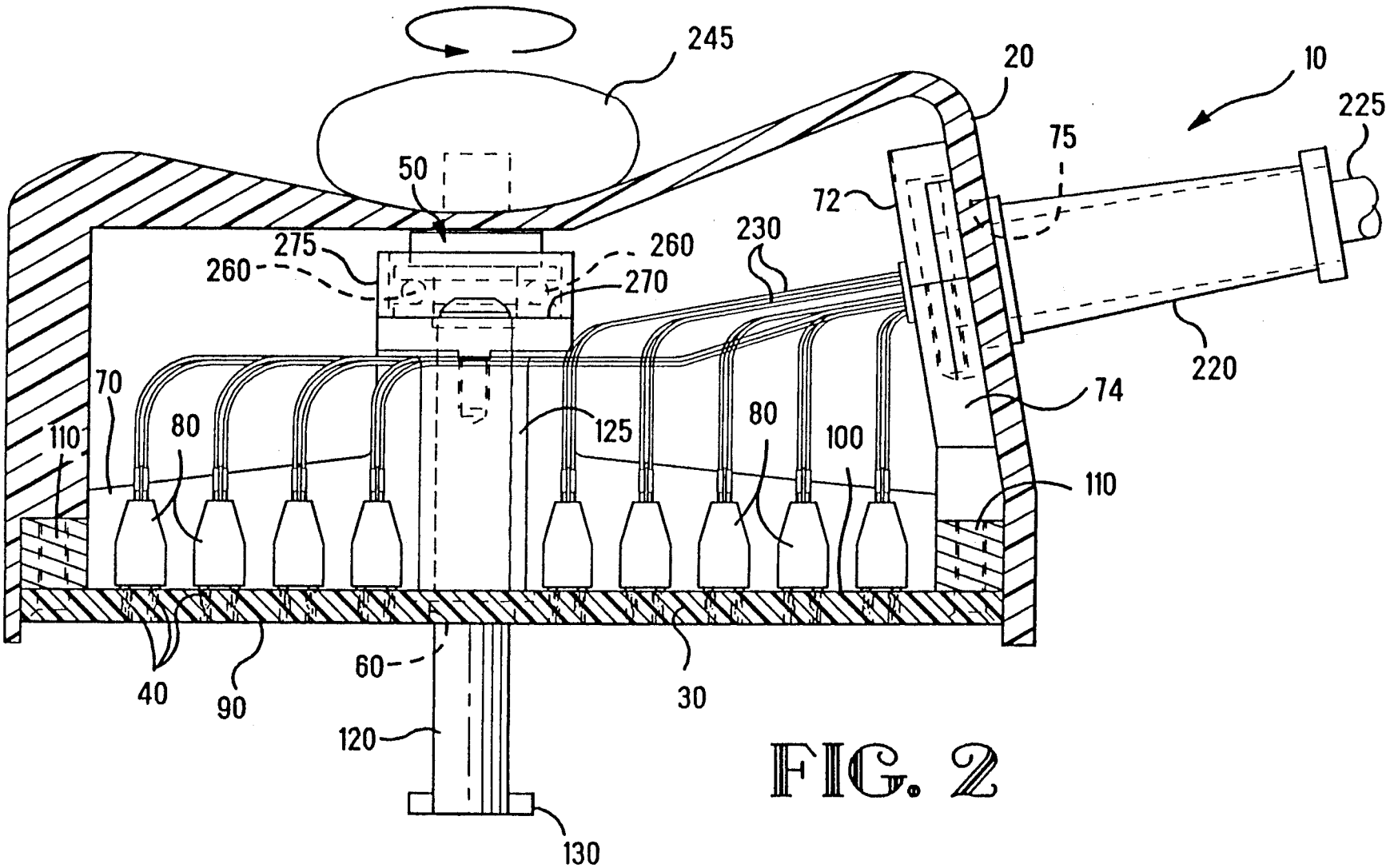
FIG. 2 is a cross-sectional elevation view of the cable side connector in accordance with the present invention having an array of connector modules terminating conductors of a cable and interfaced to a printed wiring board mounted in the connector.

As seen in FIG. 2, modular connectors 80 are mated in the plated-through-holes 40 on the PWB 30. A first side 90 is denoted the "contact" side of PWB 30 and comprises a plurality of contact surfaces outwardly exposed to make electrical contact with contacts 290 of substrate 150 in the device (see FIG. 4). A second side 100 of PWB 30 is adapted to attach PWB 30 to a securing ledge 110 on connector 10. The periphery of second side 100 of PWB 30 abuts and is fastened to securing ledge 110 after modular connectors 80 have been plugged into PWB 30 through plated-through-holes 40, which holds PWB 30 in place in connector 10. Securing ledge 110 is seen to engage peripheral edge portions of PWB 30 therearound, thereby adapted to provide support thereto generally at all reaches of the board, while exposing the interior portions of second side 100 of PWB 30 to permit electrical connection to conductive sites or plated-through holes 40 by contacts of modules 80.

Actuating means 50 is shown to comprise a securing barrel 120 that extends through a tubular housing 125 of support structure 70 and is rotationally mated through opening 60 in PWB 30 for securing and interfacing the first surface 90 of PWB 30 to the interposer secured to the substrate such as interposer 150 in the device side connector which may be an interposer or a second PWB in the device. Interlocking means 130 attached to securing barrel 120 is provided for cinching the securing barrel 120 to a cooperable locking surface in the device, such as the surface 240 in device side connector 140 of FIG. 3. Preferably, the cooperating surface 240 in the device side connector 140 is engageable interlock the barrel to the device when actuating means 50 is actuated such as by manual rotation thereof. By cinching the interlocking means 130 to the cooperable surface in the device, the securing barrel 120 will exert a sufficient force to hold the contact surfaces which are provided on the first side 90 of PWB 30 to the corresponding contacts 290 of interposer 150 in the device side connector (FIG. 4), thereby ensuring adequate electrical contact of the circuits of the PWB 30 to the circuits of the substrate.

Figure 6:
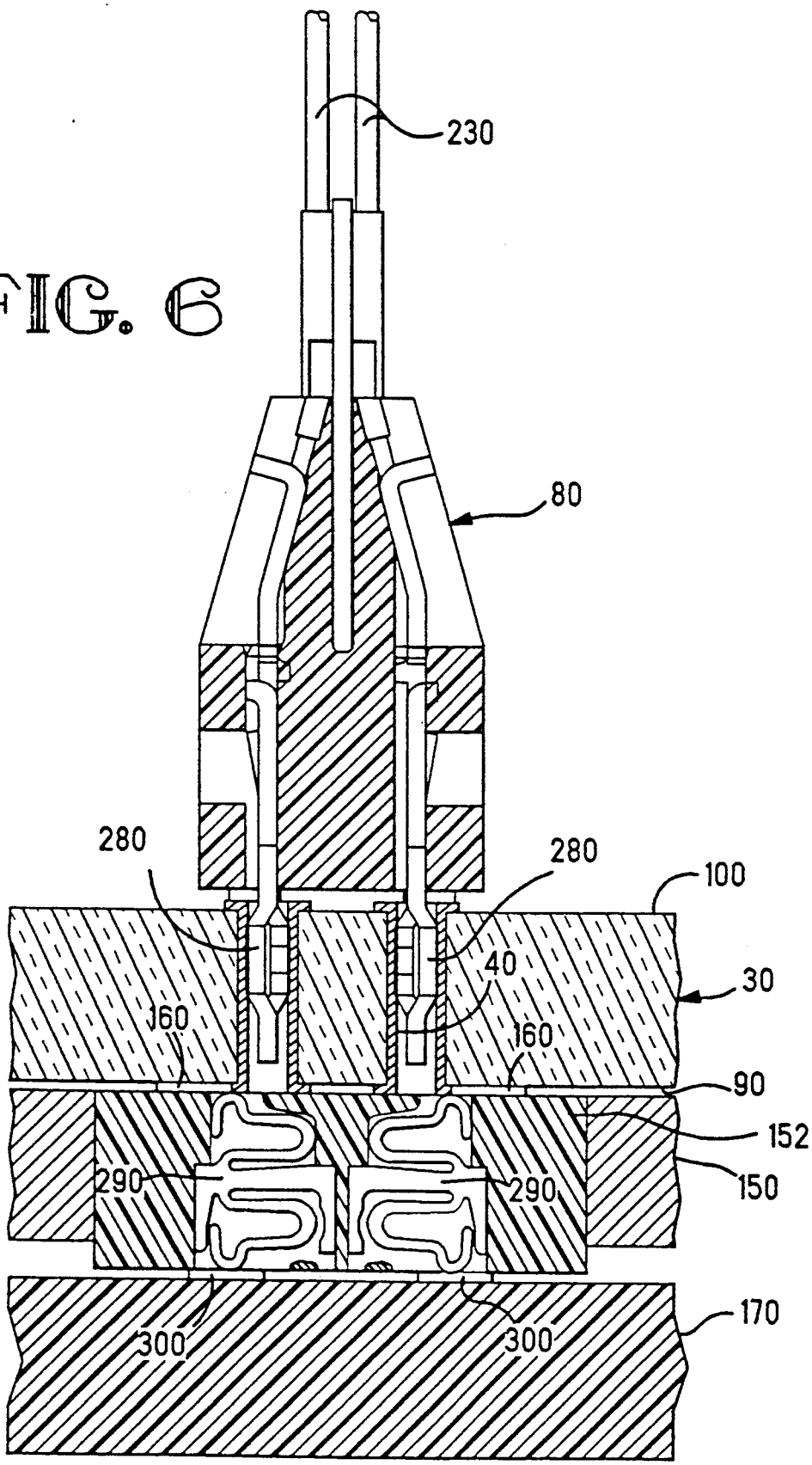
FIG. 6 is an enlarged cross-sectional view of a single connector module site of FIG. 3.
Figure 7:
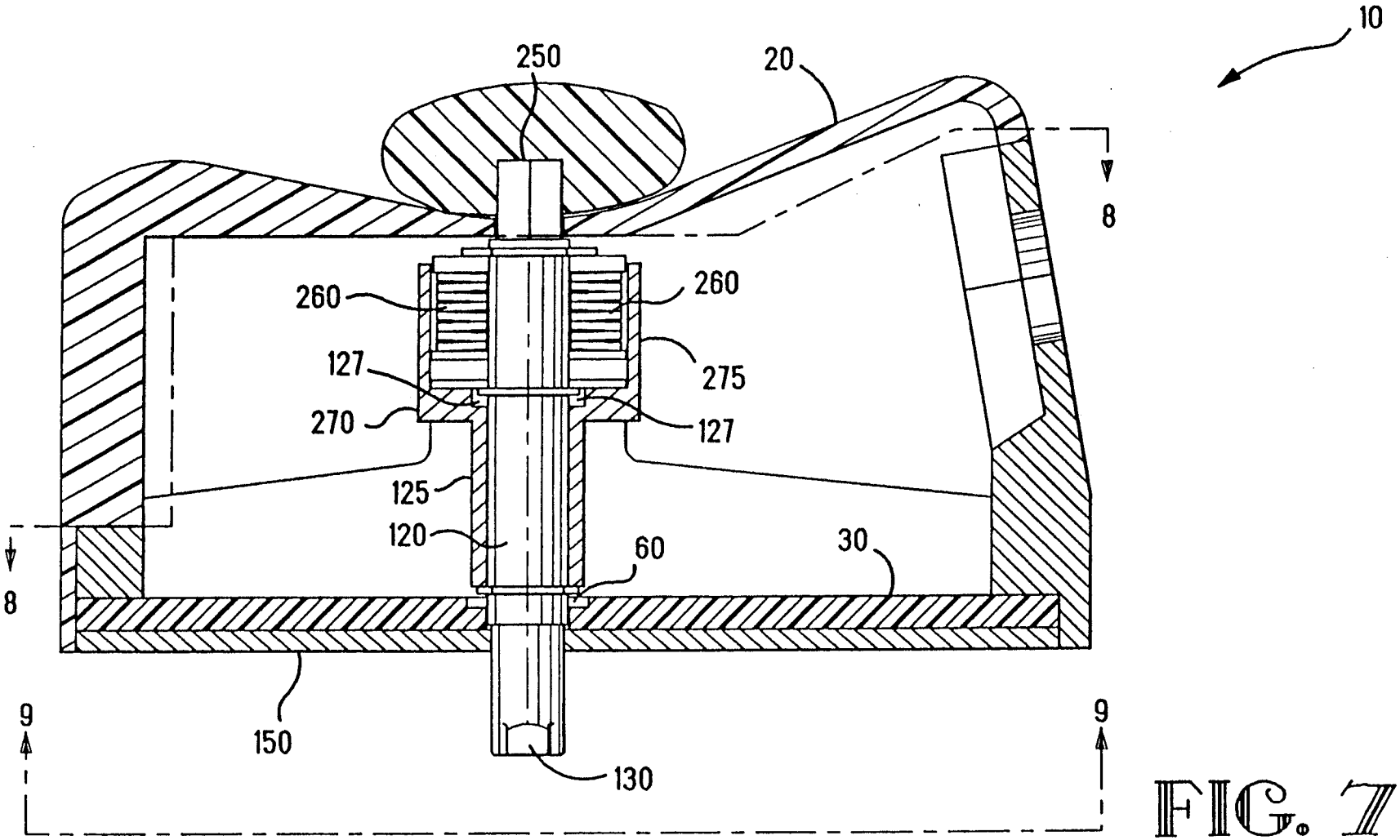
FIGS. 7, 8 and 9 are cross-sectional elevation and generalized top and bottom views respectively- of the framework of the connector provided in accordance with the present invention, with FIGS. 8 and 9 taken along lines 8—8 and 9—9 of FIG. 7 respectively.
Figure 8:
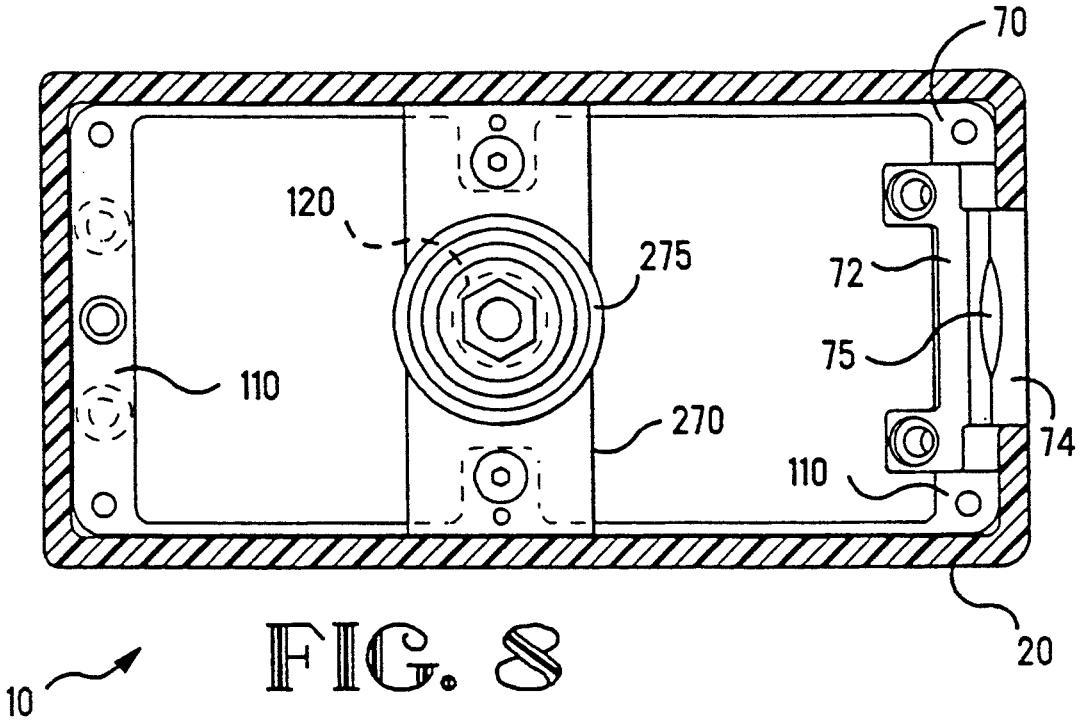

Referring to FIG. 3, connector 10 having PWB 30 secured thereto is mated with the device side connector shown generally at 140 mounted at an opening in the framework of the device and defining an input/output port. The device could be, for example, an ultrasound machine for use in analyzing ultrasound data bussed by modular connectors 80 to the connector 10. PWB 30 is in flush contact with substrate 150 in the device side connector. As best seen in FIG. 6, on the first side 90 of PWB 30, a plurality of contact surfaces 160 are in electrical communication with plated-through-holes 40. The contact surfaces 160 make electrical contact with corresponding contacts of substrate 150 so that the data signals can be bussed through the modular connectors 80 to device side connector 140.

Substrate 150 preferably comprises an interposer adapted to make electrical contact with the contact pads adjoining the plating material of plated-through-holes 40 in PWB 30, especially when the density of pins in the modular connector elements 80 is large. Interposer 150 interfaces with a system PWB shown generally at 170 which is mated to the device side connector 140 through mounting screws 180. The system PWB 170 is, for example, a motherboard, which is adapted to receive and process the data being bussed through modular connectors 80 to device side connector 140. One such interposer is disclosed in particularity in U.S. Pat. No. application Ser. No. 07/99675) filed Dec. 24, 1992.

Similarly, a group of contacts 300 on the system PWB 170 side of interposer 150 is provided to make electrical contact between the interposer 150 and the system PWB 170. It will be recognized by those with skill in the art that the interposer 150 could be assembled to PWB 30 of connector 10, or maintained in registry to system PWB 170 by alignment pins but otherwise not secured thereto or to PWB 30 of connector 10. In this situation, contact surfaces 160 would make electrical contact to the system PWB 170 through reciprocal contact surfaces on the system PWB 170.

A bolster plate 190 is mounted to the device so that the system PWB 170 can be securely mounted when attached to the bolster plate. Bolster plate 190 provides a sturdy surface for the mounting screws or studs 180 so that the connector system 10 is held in tight engagement with system PWB 170 of the device side connector 140. Mounting screws 180 extend through bolster plate 190 from chassis 360 of the device (see FIG. 5) through an aperture of inner standoff bezel 210 along the inner surface of chassis 360, with an outer bezel 200 secured to the outward surface of chassis 360 (see FIG. 4). Inner and outer bezels 210, 200 together form a frame into and through which cable side connector 10 can be guided to make contact with the interposer 150 and system PWB 170 of device side connector 140. Outer bezel 200 is secured by screws 185 extending outwardly through chassis 360 and threaded into corresponding apertures 187 of outer bezel 200. Mounting screws 180 are shown to be pressed into profiled holes 182 of chassis 360.

Connector 10 further includes a cable exit holder section 74 (FIG. 1) integrally formed with the housing 70 (FIG. 2). A clamp member 72 is fastenable to holder section 74 to define the cable exit 75 clamping therebetween cable feed tube 220 which is adapted to receive a jacketed cable 225 (FIGS. 2 and 3) containing a substantial number of discrete microaxial conductors 230 in connector 10 when clamped to an outer jacket 227 of cable 225. Cable feed tube 220 provides strain relief to the electrical terminations within connector 10. Conductors 230 terminate to respective signal and ground terminals in each of the modular connector elements 80 so that electrical signals can be bussed from the outside source through the modular connectors 80 to the device 140. Alternatively, conductors 230 could be permanently soldered through vias in PWB 30, thereby eliminating the need for modular connectors 80.

In either of aforementioned embodiments, since connectors in accordance with the present invention are particularly useful in microcoax cable applications where many such modular connectors with associated microcoax conductors are used, the cable feed tube 220 maintains conductors 230 in a neat jacketed bundle so that connector 10 can efficiently be handled and remain easily accessible for service. The bundling of conductors 230 through cable feed tube 220 also allows connector 10 to be easily mated and unmated by the user of device 140 without interference from the plurality of conductors 230. Connector 10 thus secured to an end of cable 225 defines a cable harness.

As can be seen in FIGS. 2 and 3, securing barrel 120 traverses through opening 60 in PWB 30, and corresponding openings provided in interposer 150, system PWB 170, and bolster plate 190. In a more preferred embodiment, securing barrel is a solid shaft made of a rigid material such as stainless steel. The interlocking means 130 is preferably integrally formed on a distal end of barrel 120 from the same material as barrel 120 and interfaces to the cooperating surface 240 to cinch the interlocking means 130 and barrel 120, and thus connector 10, to the device side connector 140, and thereby to the device. It will be recognized that the plate providing cooperating surface 240 could be cast in single piece with bolster plate 190 of device side connector 140, or alternatively secured thereto by screws or other fastening means.

When it is desired to mate cable side connector 10 to device side connector 140 and secure PWB 30 to interposer 150, cable side connector 10 is placed in initial operative association with the device side connector by passing the distal end of barrel 120 through the aligned openings in the interposer 150, system PWB 170 and bolster plate 190. The barrel 120 and interlocking means 130 are then preferably rotated upon manual activation of a grippable knob 245 by an engaging surface 250 that is integrally formed on a proximal end of the barrel 120 which causes the interlocking means 130 to cinch the barrel to the cooperating surface 240. This will secure the connector 10 to the device side connector 140.

When the engaging surface 250 is rotated, a set of spring members such as Belleville washers 260 within cylindrical bearing cover 275 operate on a bearing carrier 270 to transmit the force generated by the camming of interlocking means 130 downward on cooperating surface 240 and onto support structure 70 of connector 10, thereby forcing first side 90 of PWB 30 onto interposer 150 with sufficient force to bring contact surfaces 160 into electrical engagement with the contacts in the interposer 150. The force is preferably gradually applied through barrel 120 and bearing carrier 270 as the interlocking means 130 bears against the cooperating surface 240 during rotation through a quarter turn of knob 245, whereafter interlocking means 130 seats in a recess, completing the mating procedures. The Belleville washers also provide uniform achievement of the desired force to be applied onto the substrate compensating for varying thicknesses of interposer 150, bolster plate 190, system PWB 170 and PWB 30. Alternatively, cooperating surface 240 could be fitted with compression springs which would provide the uniform force application onto the substrate by the barrel.

FIG. 6 illustrates the engagement of the contact surfaces 160 with the interposer 150. The modular connector elements 80 are electrically connected to the plated-through-holes 40 of PWB 30 by electrical contacts having pin sections shown generally at 280. The pin sections 280 on modular connectors 80 make physical contact with the tin-plated surfaces of plated-through-holes 40 so that electrical transmission can occur through the plated-through-holes and contact to the interposer 150. The electrical contacts can include completed contact sections on pin section 280 such as disclosed in U.S. Pat. No. 4,186,982 to Cobaugh, the teachings of which are incorporated herein by reference. A preferred construction of modular connector elements 80 is described in U.S. Pat. No. 5,190,473, the teachings of which are also specifically incorporated herein by reference. Additionally, methods of manufacturing modular connector elements which can be used in accordance with the present connector systems are described in AMP Incorporated Technical Paper by R. Rothenberger and R. S. Mroczkowski, entitled "High-Density Zero Insertion Force Microcoaxial Cable Interconnection Technology," (1992), the teachings of which are also specifically incorporated herein by reference.

Electrical contact pin sections 280 are secured in, and conductively engaged to, the plating material of plated-through-holes 40 which are in electrical communication with contact surfaces 160 so that sufficient electrical connections are made from the outside source via coaxial conductors 230 through the modular connector elements 80 to the PWB 30. When the PWB 30 is secured against interposer 150, the contact surfaces 160 are further placed in electrical communication with interposer contact elements 290 which are secured within cavities of dielectric modules 152 of the interposer 150 as shown. The interposer contact elements 290 are also interfaced at the lower surface of the interposer 150 to contact surfaces 300 on the system PWB 170. Circuits on the system PWB 170 enable data to be bussed to the various areas on system PWB 170 which contain electronic components that process the data for the analytical or diagnostic purposes for which the device was designed.

It will be recognized by those with skill in the art that interposer contacts 290 which are interfaced to contact surfaces 160 on the PWB 30 and contact surfaces 300 on system PWB 170 must make sufficient electrical contact to ensure that data can be bussed through the connector 10 with high reliability. Thus, the correct amount of force must be applied at the interface between contact surface 160 and interposer contact 290. While several types of interposer contact elements 290 may be utilized with the present invention, preferably used is the specific embodiment shown in FIG. 6 and disclosed in aforementioned Ser. No. 07/996,751. However, the force to be applied at the contact surface 160 and interposer contact 290 interface by securing barrel 120 and bearing carrier means 270 will be gauged for the particular type of interposer contact 290 which is used in the connector system 10. Actuating means 50 for applying force in accordance with the present invention will also be useful for many types of interposer contact 290 or substrate which requires firm mating at the electrical contact interfaces to ensure high integrity electrical transmission.

Referring now to FIGS. 7 through 12, connector 10 comprising housing 20 and securing barrel 120 with interlocking means 130 is better illustrated. In further preferred embodiments the interlocking means 130 comprises a key element which is received through a corresponding key-shaped hole 155 in cooperating, surface 240 to cooperatively engage a complementary cooperating surface in device 140. It will also be recognized that the interlocking means 130 could comprise a combination of the key element and a latching pin which would further hold the barrel 120 to cooperating surface 240.

The operation of securing the connector 10 to device 140 and electrically interfacing PWB 30 to the interposer 150 is accomplished as securing barrel 120 is rotated by manual activation of knob 245. The interlocking key element 130 bears against the surface 240 during rotation which in a preferred embodiment is a key channel so that the interlocking key element 130 is cinched to the key channel. This in turn, through thrust-bearings 260, presses against bearing carrier 270 mounted atop support structure 70 carrying PWB 30 so that the PWB 30 is securely pressed against the interposer 150, with bearing carrier 270 and bearing cover 275 which is an integrally fastened part of support structure 70. Full locking is indicated to the operator by means of a ball plunger detent (not shown) that is housed in embossment 127 of bearing carrier 270 entering a recess when barrel 120 has been rotated the selected angular distance, such as a quarter turn.

Figure 10:
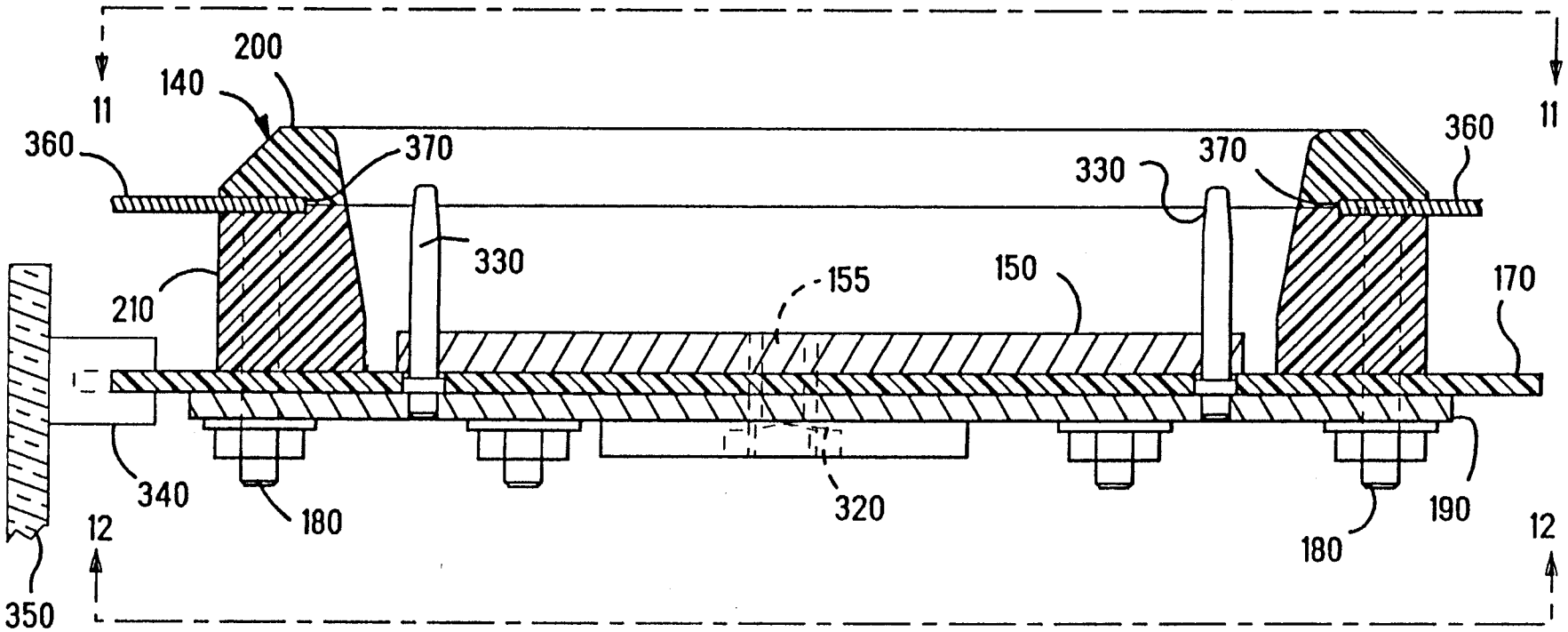
FIGS. 10, 11 and 12 are elevational, top and bottom views respectively of the device side connector of FIGS. 7, 8 and 9 showing means for securing a first printed wiring board in the connector to a second printed wiring board mated to the device.
Figure 11:
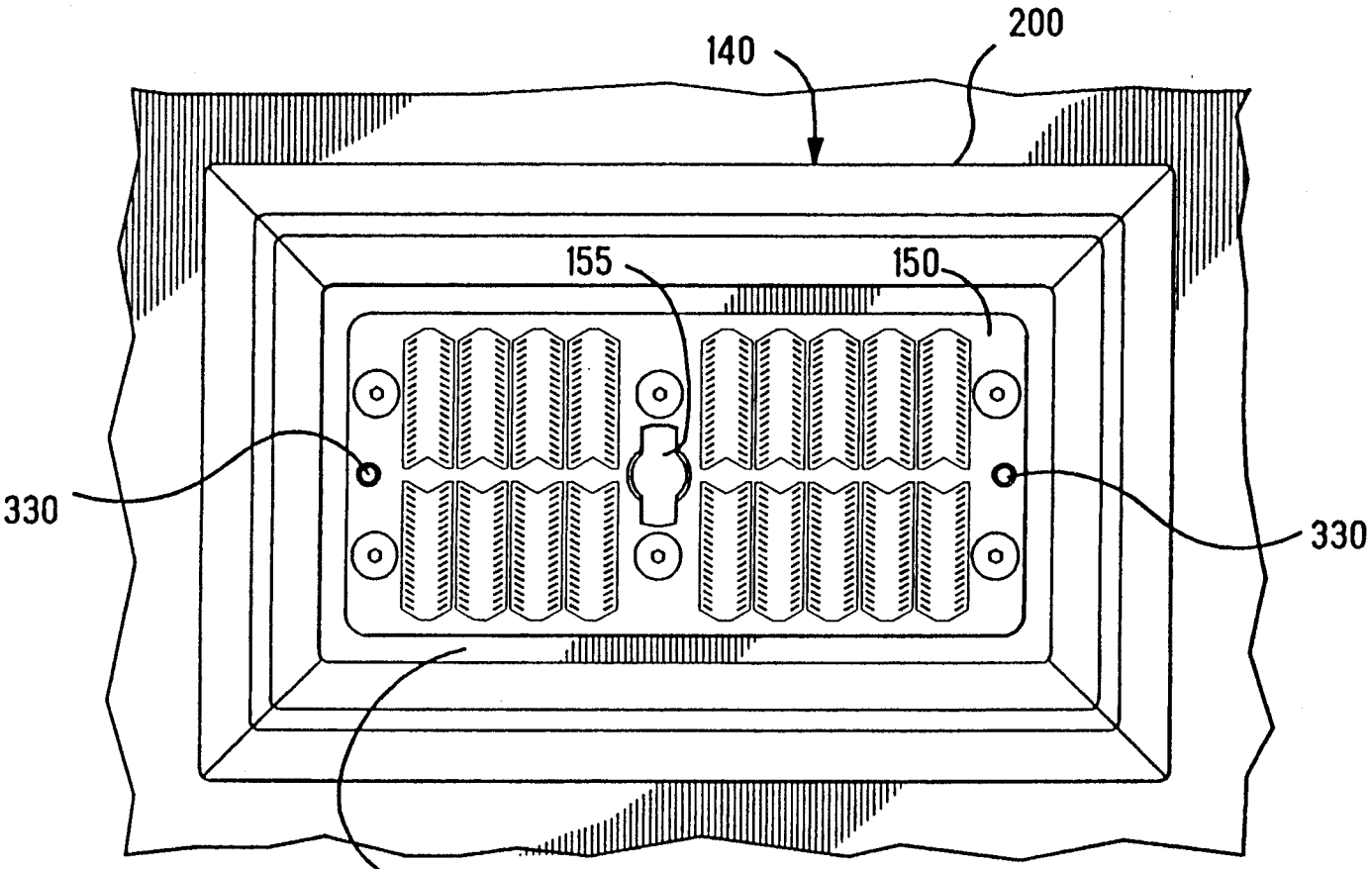
Figure 12:
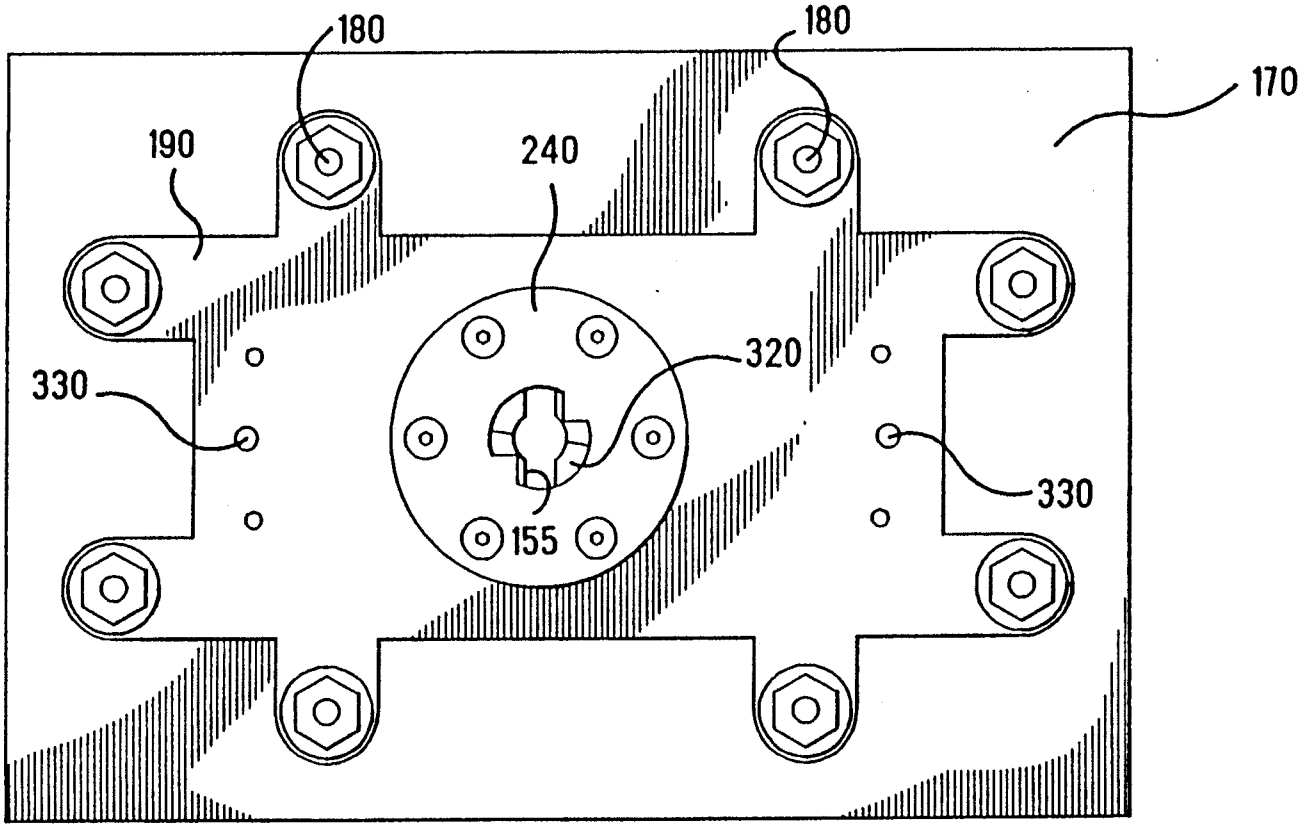

Referring now to FIGS. 10 through 12, in a preferred embodiment, cooperating surface 240 is a hub having a key camming surface 320 that is adapted to cooperatively engage with the key element 130 upon rotation of barrel 120 during manual actuation of actuating means 50. When the barrel 120 forces key 130 against the key cam surface 320, the barrel then rotates key 130 along the camming surface 320 to pull bearing carrier 270 and connector 10 down, thereby imparting sufficient force to bring the contact surfaces 160 of PWB 30 firmly against the interposer contacts 290. The bearing carrier arrangement can exert between 20 (for low contact count) and 200 pounds (for high contact count) of force to accomplish this result. In an arrangement having for example six hundred and twelve pairs of contact surfaces to be interconnected, the bearing carrier exerts 150 pounds of force to bring the interposer contacts 290 and contact surfaces 160 together. In other applications different interposer contacts may be used and different numbers of contacts may be provided, thereby modifying the amount of force necessary for assured mating.

Figure 5:
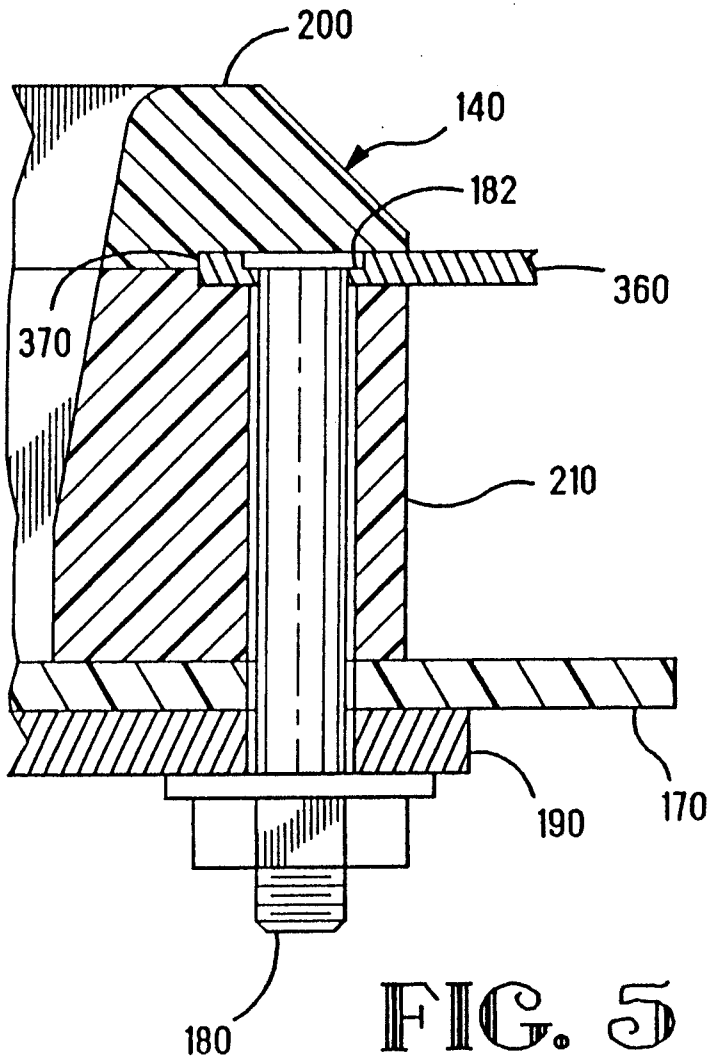
FIGS. 4 and 5 are partial sectional views of the device side connector illustrating mounting thereof to the device chassis.
Figure 4:
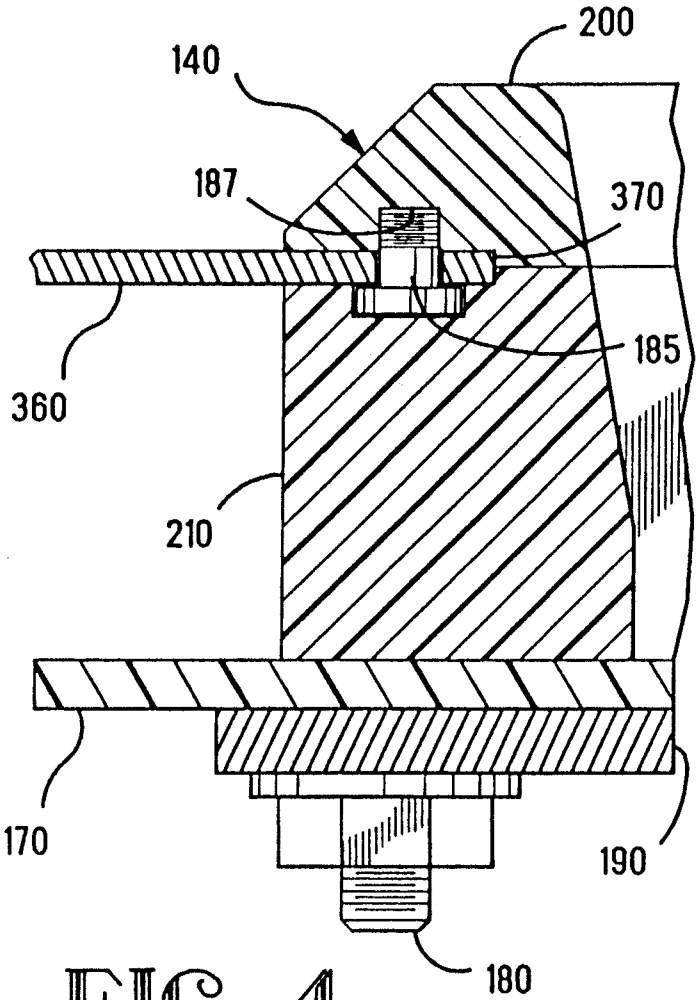

As can be seen in FIG. 10, PWB 170 on the device side connector interfaces with a card edge connector 340, within the device. The card edge connector 340 is further interfaced with a motherboard 350 in the device that receives the data signals which will be bussed through connector 10 so that the data signals can be utilized by the device. As seen in FIGS. 4 and 5, the chassis 360 of the device includes a cut-out aperture 370, so that the connector 10 can be received into chassis 360 to mate with device side connector 140 within the device. In this fashion, PWB 170 will be securely mated in card edge connector 340 so that sufficient electrical integrity is maintained for the connector as the signals are bussed therethrough.

Figure 9:
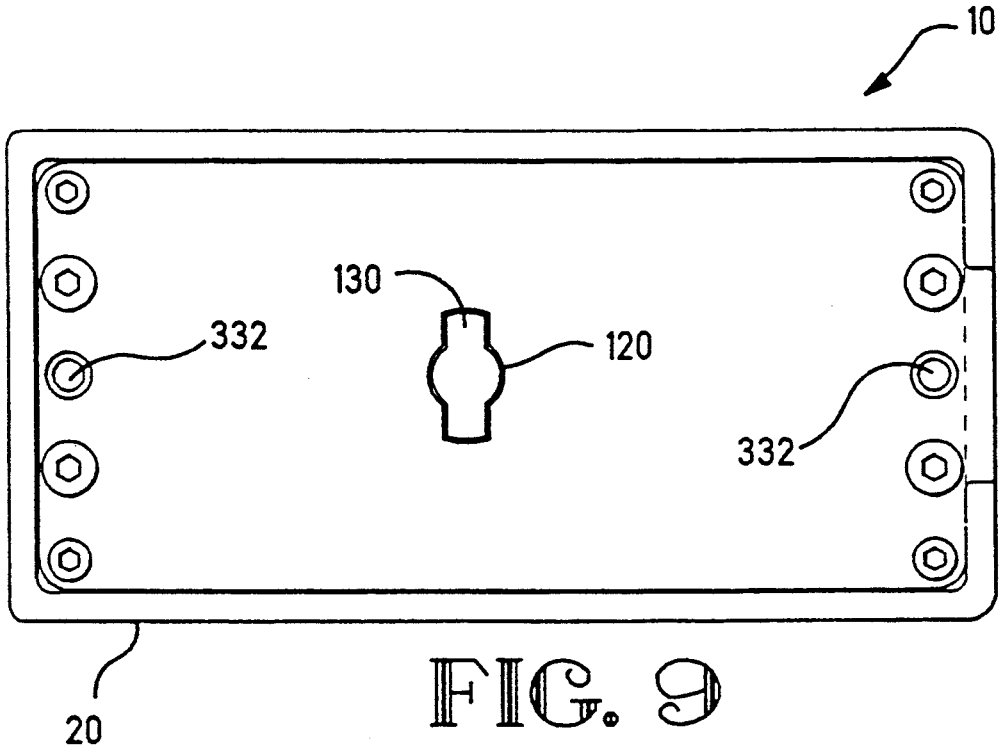

FIG. 11 is a plan view of the interposer 150 mounted in device 140. Preferably, pins 330 extending upwardly therethrough serve so as to align the PWB 30, interposer 150 and system PWB 170 precisely to align their respective contact arrays when received into complementary alignment sections 332 of connector 10 (FIG. 9). In FIG. 12, hub 240 interfaces key 130 in the reciprocal key cam channel 320 so that the key cam surface holds the key in place as the key is rotated on the key camming surface. Preferably as mentioned above, a pair of compression springs may be provided to the hub 240 to counterbalance and control the force supplied by bearing carrier 270 through support structure 70 to PWB 30.

In this arrangement, when 150 pounds of force is to be applied by bearing carrier 270 to the PWB 30 to secure the contact surfaces 160 to the interposer 150, the compression springs should compress when more than 150 pounds of force is applied by the bearing carrier 270, thereby causing the compression springs to contract, allowing hub 240 to move upwardly towards the bolster plate 190. This in turn ensures that a force of 150 pounds is applied irrespective of variations in thicknesses of PWB 30, system PWB 170, interposer 150 and bolster plate 190. Thus, in an alternative embodiments, compression springs will provide control means for ensuring that the printed circuit boards and the interposer are compressed by the desired force applied to them by actuating means 50 and bolster plate 190 as the key 130 interfaces with the cam surface 320. Also, the interlocking means 130 may be a latching pin (not shown) secured to the distal end of the barrel 120.

It can be seen from FIGS. 2, 10 and 12 that the key will traverse through opening 155 until the key 130 is first below the uppermost extent of downwardly facing cam surface 320. The barrel 120 is then rotated by manual rotation of knob 245 so that key 130 traverses along and bears against the cam surface 320 to the lowest point of the cam surface, thereby causing the thrust bearings 260 to urge support structure 70 downward and forcing the PWB 30 onto interposer 150. Thus, the contact surfaces 160 on PWB 30 are brought firmly and assuredly into flush contact with interposer contacts 290 so that adequate electrical contact is maintained through the connector and data signals can thereafter be bussed into the device in a reliable and efficient fashion. These results have not heretofore been achieved in the art and solve a long-felt need for a contact system which ensures reliable electrical contact for high density modular contact elements, in a high cycle life connecting system.

Thus the connectors and methods of using connectors described and claimed in accordance with the present invention ensure high integrity contact surface interfaces by applying the required amount of force to the mating interface to mate the contact surfaces together. This results in a highly reliable connector system which effectively guarantees that electrical signals are bussed through the system with integrity. Furthermore, the connector systems provided in accordance with the present invention are economical to produce and can be mated and unmated with several different devices which has heretofore not been possible in the art. These unexpected and highly advantageous results allow connectors in accordance with the present invention to find widespread use in the industry.

There have thus been described certain preferred embodiments of connector systems provided in accordance with the present invention, and it will be recognized by those with skill in the art that modifications are within the true spirit and scope of the invention. The appended claims are intended to cover all such modifications.

What is claimed is:

1. A connector for electrically interfacing contacts to a device containing a circuit-bearing substrate and a cooperating surface comprising:

a printed wiring board adapted to receive a multi-circuit connector element for communicating data from an outside source to the device, the printed wiring board including a mating surface having an array of conductive pads exposed thereacross associate with a corresponding array of conductive sites of the circuit-bearing substrate on an exposed mating interface thereof;

housing means for mounting the printed wiring board in a manner exposing the mating surface thereof; and securing means assembled to the housing means and extending from an exposed actuation section through and beyond the mating surface of the printed wiring board to a distal end having an interlocking means adapted to interlock with and be unlockable from said cooperating surface in the device; and the housing means including structure for supporting the securing means upon actuation thereof to receive substantial force therefrom in the mating direction and for supporting the printed wiring board at least at substantially all peripheral regions thereof to equally distribute and transmit force thereagainst, whereby upon actuation the securing means is cinched to the cooperating surface and is urged toward the device and exerts sufficient force against the support means and therefore against the printed wiring board make effective electrical contact with the corresponding conductive sites of the substrate.

2. The connector recited in claim 1 wherein the printed wiring board is rigid and the support structure engages an opposed second side of the printed wiring board along edge portions thereof peripherally therearound for supporting the printed wiring board in the connector in a manner exposing substantially all of the second side for contact sites thereon to be electrically connected by conductors of the connector element.

3. The connector recited in claim 1 wherein the securing means includes a barrel made of a rigid material.

4. The connector recited in claim 3 wherein the interlocking means includes a key element integrally formed on a distal end of the barrel.

5. The connector recited in claim 4 wherein the cooperating surface is a cam surface adapted to mate with the key element such that when the key element is rotated along the cam surface, the printed wiring board is cinched to the substrate.

6. The connector recited in claim 3 wherein the interlocking means includes a latching pin.

7. The connector recited in claim 1 further comprising at least one connector module containing a plurality of electrical contacts electrically connected to respective ones of a plurality of said contact sites for bussing data from the outside source to the conductive pads.

8. A matable and unmatable connector adapted to electrically interface contact surfaces to a device which will utilize electrical signals bussed through the connector comprising:

a printed wiring board having first and second sides adapted to interface with a connector element which will bus data from an external source to the printed wiring aboard, said printed wiring board having a plurality of contact surfaces on the first side of the printed wiring board;

a support structure for supporting the printed wiring board in the connector;

securing means affixed to and actuable with respect to said support structure between first and second positions and having a distal end extending beyond the first side of the printed wiring board and adapted to extend through an opening in the substrate and becoming adjacent a cooperating surface in the device when the securing means is in the first position, and including an actuation section remote from the first side of the printed wiring board and accessible outwardly of the support structure;

interlocking means attached to the distal end of the securing means for cinching the securing means to the cooperating surface in the device in a manner urging the securing means toward the device when the securing means is actuated to the second position, and uncinching the securing means from the cooperating surface when the securing means is moved to the first position; and the support structure including structure for supporting the securing means upon actuation thereof to receive substantial force therefrom in the mating direction and having a supporting surface for supporting the second side of the printed wiring board at least at substantially all peripheral regions thereof to equally distribute and transmit the force thereagainst, whereby actuation of the securing means to the second position causes the securing means to exert a sufficient force on the support structure and therefore on the printed wiring board to hold the contact surfaces on the first side of the printed wiring board to the corresponding contact surfaces on the substrate in the device to ensure adequate electrical contact of the pairs of associated contact surfaces.

9. The matable and unmatable connector recited in claim 8 wherein the printed wiring board having first and second sides further comprises a plurality of plated-through-holes which are in conductive relationship to the contact surface on the first side of the printed board

10. The matable and unmatable connector recited in claim 9 further comprising at least one connector module comprising a plurality of electrical contacts which are electrically engageable with the supportive ones of corresponding plurality of plated-through-holes and wherein the connector module is interfaced to the external source.

11. The matable and unmatable connector recited in claim 8 wherein the securing means includes a barrel made of a rigid material.

12. The matable and unmatable material connector recited in claim 11 wherein the interlocking means includes a key element integrally formed on a distal end of the barrel.

13. The matable and unmatable connector recited in claim 12 wherein the cooperating surface includes a cam surface adapted to mate with the key element such that when the key element is rotated along the cam surface, the printed wiring board is cinched to the substrate.

14. The matable and unmatable connector recited in claim 8 wherein the interlocking means includes a latching pin.

15. The matable and unmatable connector recited in claim 8 further comprising a housing enclosing the support structure, the securing means in a manner exposing the actuation section thereof, the printed wiring board in a manner exposing the first side thereof, and electrical connections of conductors of the connector element to respective contact surfaces of the printed wiring board.

16. The matable and unmatable connector recited in claim 15 wherein at least one of the support structure and housing are secured to an end of a cable containing the conductors and connected to the outside source and defining the connector element, in a manner relieving stress on the electrical connections and permitting no opening into the housing surrounding the cable.

17. The matable and unmatable connector recited in claim 10 further comprising a housing enclosing the support structure, the securing means in a manner exposing the actuation section thereof, the printed wiring board in a manner exposing the first side thereof, and electrical connections of the contacts of the at lets one connector module to respective contact surfaces of the printed wiring board.

18. The matable and unmatable connector recited in claim 17 wherein the contacts of the at least one connector module are terminated to respective conductors of a cable connected to the outside source and defining the connector element, and at least one of the support structure and housing are secured to an end of a cable containing the conductors and defining the connector element, in a manner relieving stress on the electrical connections and permitting no opening into the housing surrounding the cable.

19. A method of connecting a printed wiring board to a device which enables signals to be bussed thereto through the printed wiring board from an outside source, in a manner which facilitates disconnection of the printed wiring board from the device, comprising the steps of:

interfacing a first side of a printed wiring board to a contact surface in the device and exposed at an opening through framework thereof;

inserting an interlocking key element at a distal end of a shaft through a hole in the printed wiring board and into a complementary key channel in the device; and engaging and actuating an actuating section at a proximal end of the shaft accessible outwardly of a second side of the printed wiring board, thereby rotating the interlocking key element from a first angular position into the complementary key channel to a second angular position defined by the channel from which the interlocking key element is reciprocally rotatable to the first position for unlocking, thereby cinching the interlocking key element to the complementary key channel so that the printed wiring board is securely pressed against the contact surface in the device, whereby interlocking and unlocking the printed wiring board need only require access to the proximal end of the shaft of the interlocking key element to perform rotation thereof reciprocally between the first and second positions.

20. The method recited in claim 19 further comprising interfacing a connector module having a plurality of electrical contacts to a corresponding plurality of conductive sites disposed on an opposed second side of the printed wiring board.

21. The method recited in claim 19 further comprising the step of interfacing the printed wiring board to respective interposer contacts in an interposer incorporated into the device, the interposer defining the contact surface of the device and being interfaced to a second printed wiring board in the device.

22. The method recited in claim 19 wherein the complementary key channel defines a cam surface and the cinching step further comprises the step of rotating the interlocking key element along the cam surface such that as the key element is rotated along the cam surface, the printed wiring board is cinched to the interposer.

23. The method recited in claim 22 wherein the inserting step further comprises the step of rotationally interfacing a barrel through the hole in the printed wiring board wherein the key element is integrally formed on a distal end of the barrel.

24. A matable and unmatable connector adapted to electrically interface contact surfaces to circuits of a device which will utilize electrical signals bussed through the connector comprising:

a printed wiring board having a first and second side adapted to interface with a connector element which will bus data from an external source to the printed wiring board, said printed wiring board having a plurality of contact surfaces on the first side of the printed wiring board;

an interposer having interposer contacts secured to the first side of the printed wiring board;

a support structure having a supporting surface adjacent a second side of the printed wiring board for supporting the printed wiring board in the connector;

a securing barrel having proximal and distal ends rotationally mounted within and extending through the support structure, the printed wiring board and the interposer, and adapted to extend through an opening in the substrate for securing the contacts exposed across a mating face of the interposer to corresponding conductive sites on the substrate secured to the device at a connector-receiving opening thereof;

an interlocking key element integrally formed on the distal end of the securing barrel for cinching the securing barrel to a cam surface in the device as the key element is rotated along the cam surface, thereby causing the securing barrel to exert a sufficient force to hold the contact surface to the contacts in the interposer to ensure adequate electrical contact between the conductive sites of the substrate and the contacts in the interposer; and a connector module having a plurality of electrical contacts interfaced to the printed wiring board for interfacing data from the external source to the printed wiring board.

25. A matable and unmatable connector system adapted to electrically interface a high density of conductors of a multiconductor cable to circuits of a device at an input/output port thereof for bussing electrical signals over a substantial plurality of circuits and having zero insertion force for mating, the system comprising:

a connector secured to the cable and having a printed wiring board disposed across a mating face thereof, a support structure for supporting the printed wiring board, a securing means movable affixed to the support structure, and a housing enclosing the support structure and the electrical connections of the cable conductors to contact sites of the printed wiring board;

a circuit-bearing substrate mounted within the device in a manner exposing a mating interface at a connector-receiving cavity at an input/output opening through framework of the device, with circuits electrically connecting conductive sites on the mating interface to circuitry within the device, and a cam surface interiorly of the substrate adjacent an opening through the substrate; and alignment structure defined on the connector and cooperating alignment structure defined on the device at least adjacent the substrate, to be become engaged to assure precision alignment therebetween during mating;

the printed wiring board having a first and second side and having a plurality of contact surfaces on the first side thereof;

the support structure having a supporting surface adjacent the second side of the printed wiring board for supporting the printed wiring board in the connector;

the securing means including a securing barrel having proximal and distal ends rotationally mounted within and extending through the support structure with the distal end extending from the printed wiring board, with an interlocking key element integrally formed on the distal end of the securing barrel for cinching the securing barrel to the cam surface in the device as the key element is rotated along the cam surface, the support structure including structure for supporting the securing means upon actuation thereof to receive substantial force therefrom in the mating direction and having a supporting surface for supporting the second side of the printed wiring board at least at substantially all peripheral regions thereof to equally distribute and transmit the force thereagainst, whereby after insertion of the connector into the connector-receiving opening and engagement with the mating interface of the substrate at zero insertion force, rotation of the securing means to a cinching position causes the securing means to exert a sufficient force on the support structure and therefore on the printed wiring board to hold the contact surfaces on the first side of the printed wiring board to the corresponding conductive sites on the substrate in the device to ensure adequate electrical contact of the pairs of associated contact surfaces.

26. The matable and unmatable connector system recited in claim 25 wherein an interposer is secured along an exposed circuit-bearing surface of the substrate and includes an array of interposer contacts in engagement with corresponding conductive pads of the substrate and exposed to engage corresponding ones of the contact surfaces of the first side of the printed wiring board.

27. The matable and unmatable connector system recited in claim 25 wherein the cam surface of the device is defined on a plate secured interiorly of the substrate within the device.

28. The matable and unmatable connector system recited in claim 25 wherein bezels are mounted to the framework of the device surrounding the input/output port thereof extending outwardly of the mating interface of the substrate and define the connector-receiving cavity thereat.

29. A cable harness for bussing high integrity signals across a substantial plurality of conductors of a cable from an outside source to a device and adapted to interface with circuits of the device at an input/output port thereof, comprising:

a cable including a substantial plurality of coaxial conductors within a protective insulative jacket, and a connector terminated to the cable, the connector including:

a printed wiring board disposed across a mating face of the connector and including an array of contact surfaces across a first side thereof exposed to become electrically engaged with corresponding contact surfaces of a complementary substrate mounted within framework of the device at the input/output port thereof, the printed wiring board including an array of connection sites exposed on an opposed second side to which are electrically connected signal and ground conductors of the cable;

rigid support structure to which te printed wiring board is affixed, and an insulative housing surrounding the rigid support structure and enclosing the second side of the printed wiring board and the electrical connections thereto of the cable conductors, with the support structure affixed to the end of the cable at a connector cable exit and the housing providing no openings around the able exit;

securing means affixed to and actuable with respect to the support structure between first and second positions and having a distal end extending beyond the first side of the printed wiring board and adapted to extend through an opening in the substrate and becoming adjacent a cooperating surface in the device when the securing means is in the first position, and including an actuation section on a proximal end accessible outwardly of the housing on a connector face substantially opposed from the mating face;

interlocking means attached to the distal end of the securing means for cinching the securing means to the cooperating surface in the device in a manner urging the securing means toward the device when the securing means is actuated to the second position, and uncinching the securing means form the cooperating surface when the securing means is moved to the first position permitting removal of the connector from the device;

the support structure including a portion for supporting the securing means upon actuation thereof to receive substantial force therefrom in the mating direction and having a supporting surface for supporting the second side of the printed wiring board at least at substantially all peripheral edges thereof around the array of connection sites on the second side thereof, to equally distribute and transmit the force thereagainst, whereby actuation of the securing means to the second position causes the securing means to exert a sufficient force on the support structure and therefore on the printed wiring board to hold the contact surfaces on the first side of the printed wiring board to the corresponding contact surfaces on the substrate in the device to ensure adequate electrical contact of the pairs of associated contact surfaces, while return of the securing means to the first position permits immediate removal of the cable harness from the device.

30. The cable harness recited in claim 27 wherein the signal and ground conductors of the discrete coaxial conductors of the cable are terminated to signal and ground contacts at least one connector module which extend to contact sections electrically connected to respective signal and ground ones of the conductive sites of the printed wiring board.

* * * * *

UNITED STATES PATENT AND TRADEMARK OFFICE

CERTIFICATE OF CORRECTION

PATENT NO. : 5,310,352

DATED : May 10, 1994

INVENTOR(S) : Robert Mroczkowski, et al.

It is certified that error appears in the above-identified patent and that said Letters Patent is hereby corrected as shown below:

In claim 1, column 11, line 22, after "board" insert:
--for securing the printed wiring board to the substrate in the device such that the conductive pads of printed wiring board--.

Column 13:

In claim 17, line 6, change "lets" to read --least--.

In claim 29, column 16, line 19, change "able" to read --cable--; and line 36, change "form" to read --from--.

Signed and Sealed this

Twentieth Day of September, 1994

*Attest:*

*Attesting Officer*

Bruce Lehman

BRUCE LEHMAN

*Commissioner of Patents and Trademarks*